United States Patent [19]

Bonhomme

[11] Patent Number: 4,912,449

[45] Date of Patent: Mar. 27, 1990

[54] OPERATION-INDICATOR DEVICE FOR FUSE CARTRIDGES FOR ELECTRICAL PROTECTION

[75] Inventor: Christian Bonhomme, St. Bonnet de Mure, France

[73] Assignee: Ferraz, Lyons, France

[21] Appl. No.: 304,244

[22] Filed: Jan. 31, 1989

[30] Foreign Application Priority Data

Feb. 9, 1988 [FR] France ..... 88 01725

[51] Int. Cl.[4] ..... H01H 85/30

[52] U.S. Cl. ..... 337/244; 337/267

[58] Field of Search ..... 337/244, 267, 241, 265

[56] References Cited

U.S. PATENT DOCUMENTS 2,306,153 12/1942 Biermanns et al. ..... 337/244

4,387,358 6/1983 Knapp, Jr. ..... 337/244

FOREIGN PATENT DOCUMENTS 1538458 9/1969 Fed. Rep. of Germany ..... 337/244

1560404 2/1969 France ..... 337/244

*Primary Examiner*—H. Broome

*Attorney, Agent, or Firm*—Dowell & Dowell

[57] ABSTRACT

This invention relates to an operation-indicating device for fuse cartridges for electrical protection, of the type comprising a plunger formed by a pusher element which is retained against a resilient actuating member by a secondary fuse wire connected in parallel with the wire or wires or fusible elements of the cartridge, characterized in that the base of the plunger cooperates with the conventional portion of reduced section of the and secondary wire, an intermediate piece is an contact with the wire on either the of said portion and which is arranged so as to behave in non-conductive manner with respect to low-voltage current which passes through this wire and in conductive manner when the reduced section is fused so that the high-voltage current is transmitted to the two parts of the secondary wire disposed on either side of the portion of reduced section.

8 Claims, 1 Drawing Sheet

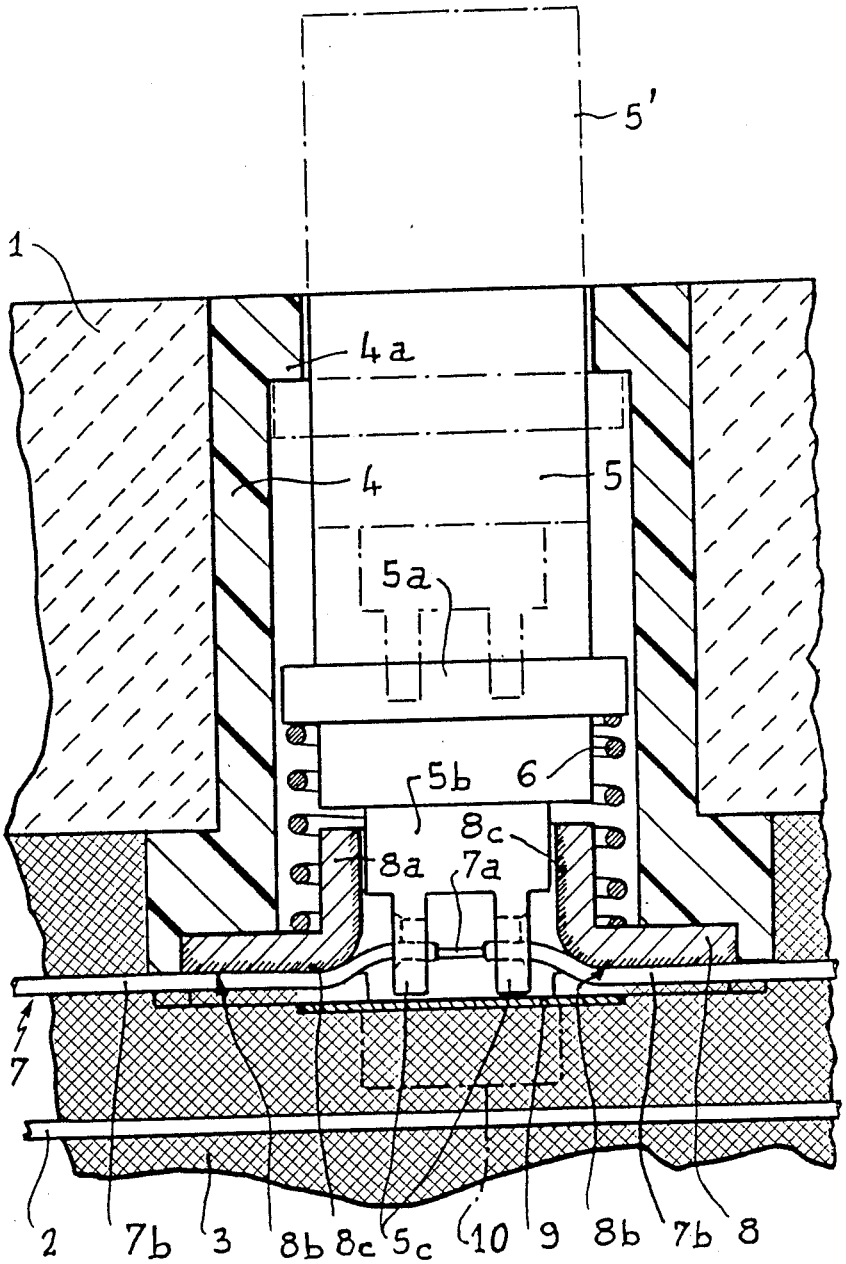
5'
1
4a
4
5
5a
5b
6
8c
8a
7a
7
2
7b
3
8b
8c
5c
10
9
8b
7b
8

OPERATION-INDICATOR DEVICE FOR FUSE CARTRIDGES FOR ELECTRICAL PROTECTION

FIELD OF THE INVENTION

The present invention relates to indicator devices mounted on fuse cartridges for electrical protection, for the purpose of indicating functioning thereof, and more particularly to so-called "plunger" or "indicator" devices of this type.

BACKGROUND OF THE INVENTION

It is known that devices of the plunger type generally comprise a sliding pusher element, or plunger, associated with and elastic member which tends to drive it axially from its guide. The plunger is retained in the inner, or retracted, position by a fusible wire of reduced section which is mounted in parallel with the wire or wires or principal fusible elements of the cartridge in order to melt and release the plunger as soon as these principal fusible wires have melted. The free end of the indicator plunger thus released appears outside the cartridge and indicates to the user that the latter has functioned. In a variation, the release of the plunger may be used to actuate the movable member of a micro-switch which connects in circuit a signalling or effects remote-control.

For such a system to be able to operate correctly, it is, of course, necessary for the fusion of the secondary fuse which retains the plunger against the elastic actuating member, to occur at the level of the base of the plunger which cooperates with this secondary fuse; this is obtained by providing the latter with a portion of reducd section. Under these conditions, the arc and vapours or gases generated by the cut of the retaining fuse may escape to the outside through the annular clearance formed between the outer wall of the plunger and the radial shaft which forms a guide for the slide thereof.

Direct escape of this break-induced arc and of the vapours generated may present risks of damage for apparatus disposed in the vicinity of the fuse cartridge, so that the indicator devices of the above type have had to be provided, at least for certain applications, with a damper arranged so as to oppose the outlet of the arc and to slow down evacuation of the vapours by effecting lamination thereof. Such a damper obviously complicates the construction of which the cost is thus increased, at the same time its presence substantially increases the dimensions of the cartridge, already increased by the alarm micro-switch possibly associated with the indicator device.

SUMMARY OF THE INVENTION

It is a particular object of the present invention to overcome the aforementioned drawbacks, by providing, at the level of the base of the plunger which cooperates with the portion of reduced section of the retaining fuse, an intermediate piece which is in contact with the fuse on either side of the portion. The intermediate piece is arranged so as to behave, on the one hand, in non-conductive manner with respect to the low-voltage current which passes through the fuse and therefore not to shunt the reduced section of the fuse when the cartridge is traversed by the nominal current, thus allowing with certainty the fusion of the portion of reduced section as soon as the principal fuses have melted. On the other hand, the intermediate piece acts in conductive manner very rapidly after fusion of the reduced section, consequently ensuring, in the manner of a shunt, the transmission of the current between the two parts of the retaining fuse disposed on either side of the portion of reduced section once a certain threshold is exceeded, and thus acting in the manner of a discharger, and this up to virtually total fusion.

It will be readily appreciated that such an arrangement allows the dissipation, within the coating mass which surrounds the principal and secondary fuses, of the vapours generated by the fusion of the secondary retaining wire, and this without it being necessary to provide an outside damper.

BRIEF DESCRIPTION OF THE DRAWINGS

The invention will be more readily understood on reading the following description with reference to the accompanying drawings, in which:

The single FIGURE is an axial section illustrating the arrangement of an operation-indicator device according to the invention.

DETAILED DESCRIPTION OF THE DRAWINGS

Referring now to the drawing, reference 1 designates the insulating casing (generally ceramic) of a fuse cartridge of conventional type, of which 2 indicates one of the principal current-transmitting fuse elements, these elements 2 being disposed inside a coating mass 3 made of agglomerated silica. This casing 1, which may be assumed to be of circular section, contains a radial shaft 4 made of an insulating material, inside which is slidbly mounted a plunger formed by a cylindrical pusher element 5. The latter presents an annular projection 5*a* against which acts a spring 6 which tends to drive the plunger out of the shaft 4 (position 5'). The displacement is limited by abutment of the projection 5*a* against an inner flange 4*a* provided at the end of the shaft.

The base 5*b* of the plunger 5, of smaller diameter, is provided with a catching device 5*c* to allow passage of a secondary fusible wire 7 which is embedded inside the coating mass 3 and which is intended to retain the plunger 4 in the retracted position shown. It should be observed that, at the level of the catching device 5*c*, this secondary wire 7 comprises a central portion 7*a* of reduced section.

According to the invention, an intermediate piece or washer 8 has been provided at the base of the shaft 4, which forms stop for the lower end of the spring. The base 5*b* and the catching device 5*c* of the plunger 5 are engaged in the axial opening of a collar 8*a* of the washer 8, the lower face of the washer being diametrically grooved at 8*b* in order to form a passage or guide for the secondary wire 7.

This washer 8 must be of non-conductive nature for the low-voltage currents, and, on the contrary, must become conductive after fusion of the part 7*a* of reduced section when the voltage at the terminals of the part 7*a* exceeds a certain threshold. To that end, the washer 8 may be made of aluminium or an alloy based on aluminium. The inner wall of the collar 8*a* and the whole of the lower face, including the groove 8*b*, being subjected to an operation of anodization, and covered with a fine layer of alumina 8*c* which ensures electrical insulation thereof.

It will be understood, under these conditions, that, when the cartridge is traversed by the current for which it is intended, the intensity of the current which passes through the secondary retaining wire is virtually zero.

The insulating layer which covers the lower face of the washer 8 proves sufficient and avoids any short circuit despite the fact that the wire 7 is applied against the bottom of the groove 8*b*.

On the contrary, when, under the effect of an overintensity affecting the circuit protected by the fuse cartridge in question, the principal fuse elements 2 melt, the whole of the current passes through the secondary wire 7, so that the latter explodes at the level of the portion 7*a* of reduced section, releasing the plunger 5. Simultaneously, this fusion generates an elevation in voltage between the two points of contact of the wire 7 with the washer 8, provoking the destruction of the insulating layer 8*c* which covers the inner face of said washer 8, which thus becomes conductive, performing the role of a discharger. Due to this conductivity, the break-induced arc may extend on either side of the shunt thus formed by the washer 8, ensuring fusion of the lateral parts 7*b* of the secondary wire 7 disposed on either side of the portion 7*a*, and effecting the absorption, in the mass 3, of the vapours generated, which do not, therefore, escape to the outside despite the fact that the device is not equipped with any conventionl damper.

It goes without saying that, in order to avoid any risk of unintentional conductivity of the washer 8 under low voltage, it is necessary to provide the zone which joins the lower face of the washer to the inner face of the collar 8*a*, with a much rounded profile, eliminating any edge likely to damage the fine insulating layer 8*c*.

In the same way, it is indispensable to provide, between the coating mass 3 and the space which surrounds the catching device 5*c*, a separation forming an inner chamber for the fusion of the portion 7*a*. To that end, a film such as 9 may be used, or a pellet (broken line 10), made of an expanded synthetic material capable of melting during the hot treatment which ensures agglomeration of the siliceous mass 3.

It must, moreover, be understood that the foregoing description has been given only by way of example and that it in no way limits the domain of the invention which would not be exceeded by replacing the details of execution described by any other equivalents.

What is claimed is:

1. In an operation-indicating device for fuse cartridges for electrical protection, of the type comprising a plunger indicator which is normally resiliently biased by a resilient member but which is retained against actuating by a secondary fuse wire connected in parallel with a first fusable element of the cartridge and wherein the first fusable element and secondary fuse wire are generally embedded in a coating mass and wherein the secondary wire includes a reduced portion, the improvement comprising, said plunger indicator including a base portion which is normally engaged with the seondary wire adjacent the reduced portion thereof so as to retain said plunger indicator against said resilient member and which is released by the secondary wire upon destruction of the reduced portion thereof so that said plunger indicator is moved by the resilient member, an intermediate secondary wire contact element, said contact element having a base portion which contacts the secondary wire on either side of the reduced portion thereof, said intermediate member being non-conductive in response to low voltage through the secondary wire and conductive in response to high voltages which fuse the reduced portion of the secondary wire, whereby said contact element shunts such high voltages to either side of the secondary wire upon fusion of the reduced section.

2. The operation-indicating device of claim 1 wherein the base portion of the contact element includes a layer of insulating material which is destroyed by the high current which passes through said secondary wire.

3. The operation-indicating device of claim 2 wherein said contact element includes an axial collar which extends upwardly from said base portion, said base portion of said plunger indicator being positioned within said collar when said base portion of said plunger indicator is engaged with said secondary wire.

4. The operation-indicating device of claim 2 wherein said base portion of said contact element includes a lower face, and a groove formed in said lower face of said base portion of said contact element for cooperatively receiving said secondary wire therein.

5. The operation-indicating device of claim 2, wherein said base portion of said contact element is made of aluminum, said insulating layer including an anodized layer of alumina.

6. The operation-indicating device of claim 1, including a chamber formed in said coating mass, said reduced section of said secondary wire and said base of said plunger being disposed within said chamber.

7. The operation-indicating device of claim 6, in which said chamber is separated from said mass by a film layer.

8. The operation-indicating device of claim 6, wherein said chamber is separated from said coating mass by a pellet of expanded synthetic material which is capable of melting during hot agglomeration of the coating mass.

* * * * *